United States Patent [19]

Fireman et al.

[11] Patent Number: 4,996,730

[45] Date of Patent: Mar. 5, 1991

[54] SUPPORTED SOFA BED RECLINER

[76] Inventors: Robert Fireman, 785 W. End Ave., New York, N.Y. 10025; Gary Shaffield, 220 Gillen Dr., Sparta, Tenn. 38583

[21] Appl. No.: 464,163

[22] Filed: Jan. 12, 1990

[51] Int. Cl.[5] ..... A47C 17/17

[52] U.S. Cl. ..... 5/37.1; 5/47; 5/41; 5/48

[58] Field of Search ..... 5/17, 18 R, 41, 47, 5/48, 56, 181, 185, 312

[56] References Cited

U.S. PATENT DOCUMENTS

| | | | |
|---|---|---|---|
| 947,472 | 1/1910 | Lehman | 5/312 X |
| 2,294,475 | 9/1942 | McAllister | 5/47 |
| 3,002,198 | 10/1961 | Kaiser, Jr. | 5/41 |
| 3,107,364 | 10/1963 | Simmons | 5/48 X |
| 3,140,114 | 7/1964 | Stephenson et al. | 5/48 X |
| 3,634,893 | 1/1972 | Hern et al. | 5/47 X |
| 4,205,405 | 6/1980 | Hagney | 5/44 R |
| 4,642,823 | 2/1987 | Wiggins | 5/47 |
| 4,829,611 | 5/1989 | Fireman et al. | 5/37 R |
| 4,875,244 | 10/1989 | Tremblay | 5/47 X |

*Primary Examiner*—Michael F. Trettel

*Attorney, Agent, or Firm*—Auslander & Thomas

[57] ABSTRACT

A sofa bed recliner with a back frame that has no rearward movement when converting from a sitting position to a horizontal position, is provided with simple support legs, which facilitate the ease of converting and reverting the sofa bed recliner and providing proper support against overbalancing. The legs drop from beneath the seat frame when it is pulled forward and retract over the base, beneath the seat frame, when reverting. The legs have a stop so that they cannot get entangled with the base when the seat frame us lifted. A tension spring biases the back frame to facilitate movement.

18 Claims, 1 Drawing Sheet

SUPPORTED SOFA BED RECLINER

BACKGROUND OF THE INVENTION

The present invention is a sofa bed recliner, an improvement of U.S. Pat. No. 4,642,823.

The present invention supplies easily extendable and retractable legs to a seat frame for a sofa bed recliner.

Where the sofa bed recliner of the present invention is placed against a wall, the opening of the sofa bed recliner moves the back frame forward and downward to the base from the sitting position to horizontal position. The base acts as a means to mount the seat frame and back frame. The back frame flattens as it moves forward, from its upright position to a horizontal position. In so doing, the back frame moves forward without any backward movement, allowing the sofa bed recliner to be fully opened without having to move the sofa bed recliner backwards from its fixed position, particularly when it is against the wall. The same structure also has the full advantage of being able to retain a fixed position in its transition from seat to bed to be fully functional as a recliner.

In a preferred embodiment, the length and width of the back frame and the seat frame are such that, when opened into a horizontal position for sleeping, the back frame and seat frame are the full size of a double bed supported on the mount.

In order to enable effective use of the support as sleeping furniture, legs are extended underneath the projecting seat frame.

The seat frame and back frame are preferably interlockable when reverting sofa bed recliner from horizontal position to sitting position.

The present invention is particularly adapted for use with a futon. Futons have become popular, offering the advantage of convertible structure adaptable for both sitting and sleeping. The present invention is a support structure for a futon, having the combined advantage of being a supported seat and a sofa bed recliner. The futon is used on the sofa bed recliner as a combination seat cushion and mattress which can function without having to be removed as the sofa bed recliner transforms from a sofa to a bed and to a recliner. The sofa bed recliner of the present invention is in effect an adaptable futon or mattress or cushion support styled to function as a unique sofa bed recliner.

A mattress may be used with the sofa bed recliner of the present invention. A futon when used in conjunction with the support of the present invention has the distinct advantage of functioning as a comfortable mattress as well as a seat cushion and back rest in all positions, seat, recliner and bed. A mattress then does not have to be shifted onto the sofa bed recliner support.

The present invention has the advantage of the space saving of a futon supported on a structure, which also saves space.

Particularly when it is desirable to have a sofa bed recliner open to the size of a full bed, the seat frame of a sofa bed recliner extends a substantial distance beyond the front of the base when the seat frame is in horizontal position. When this happens it is necessary to support the seat frame so that in use the sofa bed recliner is not overbalanced by the weight on the extended seat frame.

In sofa bed recliners such as in the present invention the back frame slides forward without rearward movement. It is preferable to have a support arm mounted to the back frame intermediate of its vertical length at the the rear of the back frame. When the seat frame is pulled forward to place the sofa bed recliner in its horizontal position the back frame then pivots backward as it is being pulled forward pivoting with the seat frame, without not extending rearward.

In another preferred embodiment a tension spring biases the support arm against the back frame to prevent an over rapid drop of the back frame, because of its weight, on to the base when placing the sofa bed recliner in horizontal position.

In the past some form of support had to be provided for the seat frame which, when extended beyond the base tended to overbalance the sofa bed recliner, from weight applied to the seat frame. The prior art provided many complex or awkward solutions to the problem of providing seat frame support in a sofa bed recliner that did not have to be pulled back from a wall. The present invention supplies such support, conveniently, during the course of moving the sofa bed recliner to a horizontal position and reverting the sofa bed recliner to a sitting position.

DESCRIPTION OF THE PRIOR ART

U.S. Pat. No. 4,642,823 typical of the prior art, provided a pair of legs extendable from the front of the seat frame. These legs had to be extend for support then retracted when the sofa bed recliner was reverted from sitting position.

U.S. Pat. No. 4,205,405 discloses a seat portion in a sofa bed which is extendable with fixed support legs. The back frame is held by a support arm so that the back frame pivots forward without extending backward. The particular configuration is not to provide the simple sliding forward movement to put it into a horizontal position. The fixed legs also do not have to pass over a base as in the present invention so the problem of manipulating support legs is not dealt with.

U.S. Pat. No. 3,634,893 discloses another back frame which does not extend backward when in horizontal position. The sofa bed has a fixed leg support substantially as disclosed in U.S. Pat. No. 4,205,405.

U.S. Pat. No. 3,107,364 provides a back frame configuration similar to the present invention and the other the prior art references and provides a complex mechanically extendable support legs.

A BRIEF SUMMARY OF THE INVENTION

According to the present invention a sofa bed recliner having a seat frame and a back frame supported on a base is provided with at least one support leg on the seat frame. The back frame is engaged with a support arm and with guide means in the end portions of the base so that the back frame moves forward and down without any substantial backward movement. The sofa bed recliner does not have to be moved, such as moved back from a wall in order to open to horizontal position. The support leg or legs are retracted when the sofa bed recliner is in sitting position and the seat frame is pushed backward, or lowered on to the base. When the sofa bed is then converted to horizontal position, the seat frame is pulled forward on the base. The support leg or legs extend over the base and drop by gravity when the seat frame is sufficiently extended. Reverting the sofa bed recliner to sitting position, the seat frame is pushed backward or downward, engaging the legs on the cross bar of the base, retracting them under the seat. A stop is provided so that the leg can only extend to a 90° angle from the seat frame, to make certain that the leg or legs will engage the cross piece of the base when the sofa bed recliner is being reverted to sitting position.

The sofa bed recliner the present invention has a back frame which when moved forward has substantially no rearward movement. There is a seat frame, a back frame, and a base, the seat frame and the back frame are movably joined. The base includes end portions, a rear cross piece, and a front cross piece. The back frame and the seat frame are mounted on the base. There is at least one support arm between the back frame and the base. The support arm is movably engaged. There are guide means between the back frame and the base. The seat frame slideably rests on the front cross piece of the base. The guide means slideably support the back frame. The seat frame and the back frame may move forward to a horizontal position and back to a sitting position. The back frame rests on the rear cross piece when the seat frame and the back frame are in a horizontal position. The seat frame includes at least one leg. The leg may freely rotate to extend and return to the seat frame. The leg supports the seat frame when the seat frame and the back frame are in a horizontal position.

The back frame may be biased against rapid movement, especially toward the rear cross piece, such as by a tension spring. The biasing spring may be mounted on the support arm.

There may be means to stop free rotation of the leg substantially at a right angle to the seat frame, such as a stop pin which may be in an end rail of the seat frame. The top of the leg adjacent the stop pin may be rounded.

The leg may be guided to return beneath the seat frame guided by the front cross piece when the sofa bed recliner is reverted to sitting position and the the leg may be retained between the seat frame and the front cross piece when the sofa bed recliner may be in the sitting position.

There may be more than one support arm or even a single support arm which may be located in the middle of the back frame. There may be more than one leg or even a single leg which may be located in the middle of the seat frame.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWINGS

Referring now to the figures in greater detail, where like reference numbers denote like parts in the various figures.

DETAILED DESCRIPTION

Referring now to the figures in greater detail, where like reference numbers denote like parts in the various figures.

Figure 1:
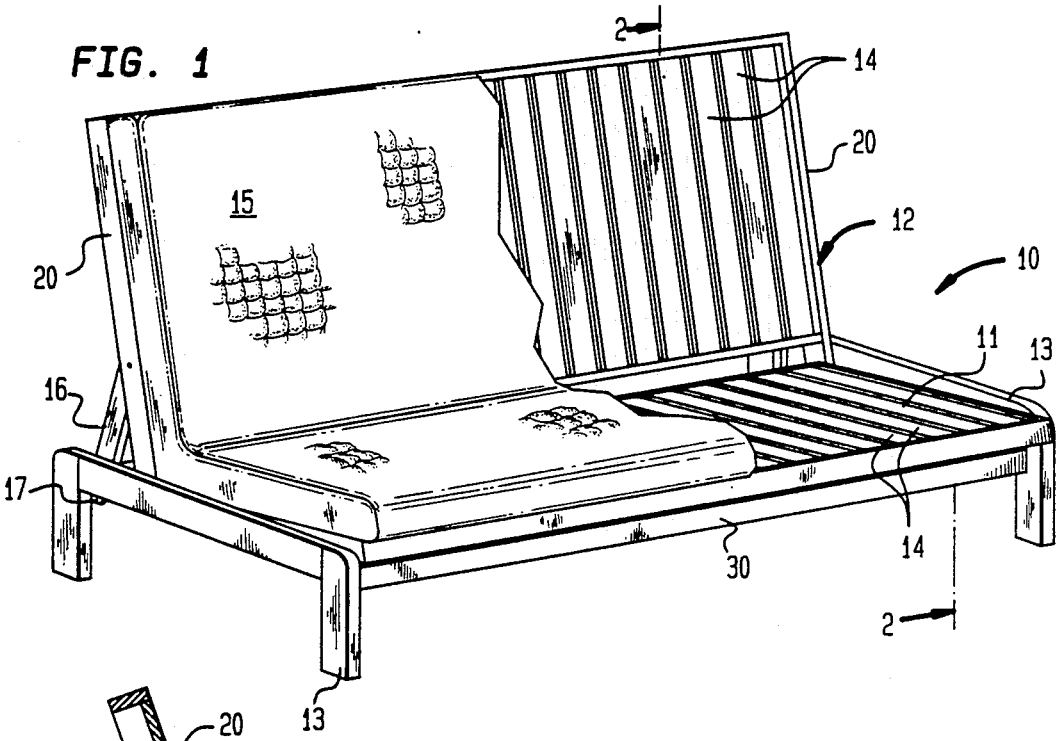
FIG. 1 is a perspective view of the sofa bed recliner of the present invention with a futon partially cut away.

The sofa bed recliner 10, as shown in FIG. 1, includes a seat frame 11, back frame 12 and base 13 for the seat frame 11 and back frame 12. The seat frame 11 and back frame 12 are provided with webbing 14 usually in the form of slats or metal spring webbing. As can be seen in FIG. 1, a futon 15 is placed over the webbing 14 of the seat frame 11 and back frame 12, providing the basic cushioning for the sofa bed recliner 10 of the present invention. Preferably, the seat frame 11 and back frame 12 each are the full length of a bed and when in a horizontal position, open to the size of a normal double bed.

Figure 2:
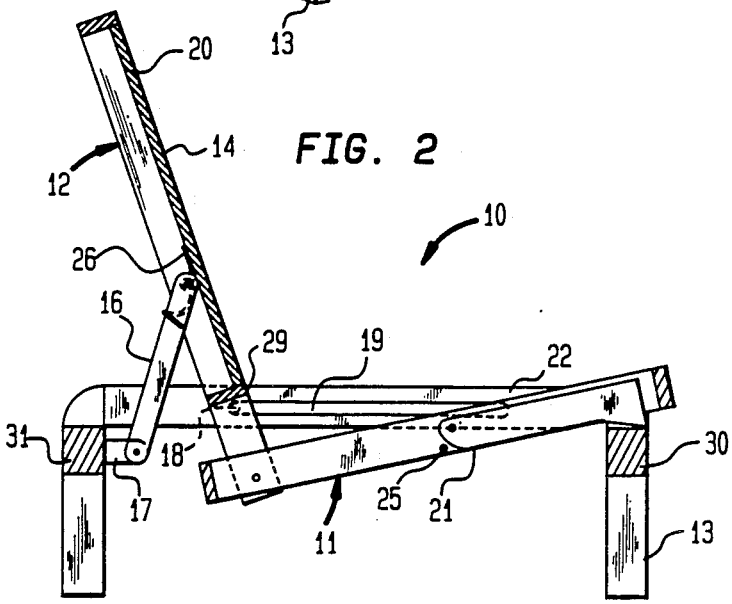
FIG. 2 is a section of FIGS. 1 at lines 2—2.

As shown in FIG. 2, the back frame 12 is mounted on the base 13 by a support arm 16 pivotally mounted on an L bracket 17 at one end and pivotally mounted on the back frame 12 at the other. A wheel 18 extends from the frame 12 and is rollably engaged in the groove 19 so that the back frame 12 may rotate as it moves in the groove 19. The wheel 18 and groove 19 interact to pivot the back frame 12 allowing it to move to a horizontal position, guided, with respect to the base 13 and to pivot to the horizontal position juxtaposed to the seat frame 11.

The end rails 20 of the back frame 12 extend beyond the configuration of the basic back frame 12 and are pivotally attached to the seat frame 11 at both ends.

Figure 3:
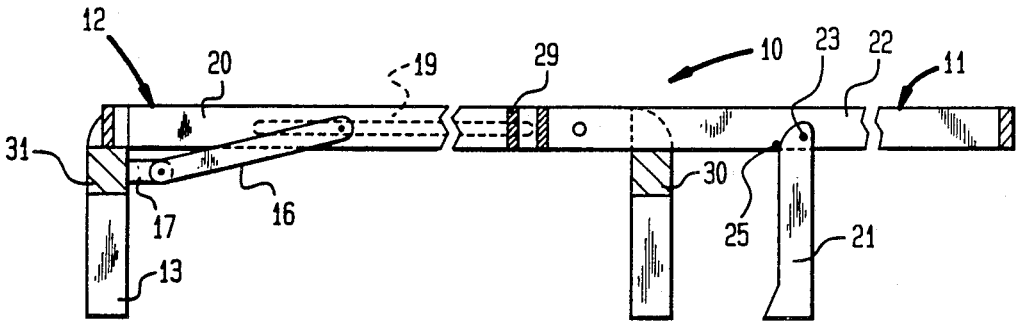
FIG. 3 is a section of the sofa bed recliner of the present invention in its horizontal position with support legs extended, and shown without any webbing and without a tension spring.

The seat frame 11, as shown in FIG. 3, includes a pair of legs 21 pivotally mounted on end rails 22 of seat frame 11. The legs 21 can freely rotate about a pivot 23. The leg 21 is stopped by a stop pin 25 in the end rail 20 so that it can move no further than 90° from the plane of an end rail 22.

A tension spring 26 engaged around the pivot of the support arm 16, as shown in FIG. 2, engages the webbing 14 of the back frame 12 at one point and a support arm 16 at another.

OPERATION

In operation the sofa bed recliner 10, as shown in FIG. 1, being used as a seat, has a futon 15 placed over the back frame 12 and seat frame 11 to serve as a normal sofa cushion.

The seat frame 11 rests on the front cross piece 30 at one end and is pivotally mounted to the end rails 20 of the back frame 12. The end rails 20 have ends extending beyond the front rail 29 of the back frame 12. The seat frame 11 is supported at its other end by a pivot, mounting it to the back frame 12. The back frame 12 is held by the support arm 16 and the wheel 18 in the groove 19. The support arm 16 is pivotally mounted at one end to the L bracket 17 and at the other end to the back frame 12. Thus, when the seat frame 11 is pulled forward to open the sofa bed recliner 10 as a bed, the back frame 12 moves forward guided by the wheel 18 in the groove 19 while the back frame 12 tilts backward as the seat frame 11 and back frame 12 moves to a horizontal position as a bed.

The sofa bed recliner 10 does not have to be moved to be opened even if it is backed up to a wall, since the back frame 12 pulls forward as it moves downward without moving any farther back. In its horizontal position, the back frame 12 rests on the rear cross piece 31 of the base 13.

Since the back frame 12 moves forward to open, the seat frame 11 compensates by protruding, as can be seen in FIG. 3, thus it is important to provide legs 21 to prevent the weight of a user from over balancing the sofa bed recliner 10. The legs 21 rotate downwardly from their retracted position in the back frame 12 to provide the necessary support.

In the preferred embodiment, the seat frame 11 and back frame 12 are equal in width to half of a double bed and in length to the full length of a double bed, thus when opened, with a futon 15 used as a mattress, the sofa bed recliner 10 serves as a full double bed.

The seat frame 11 and back frame 12 can hold relative selected positions and function as a recliner if desired.

The tension spring 26 (not shown in FIG. 3), biased against the webbing 14 and the support arm 16, improves the function of the sofa bed recliner 10 by counterbalancing the weight of the back frame 12, so that when the seat frame 11 is moved forward to place the sofa bed recliner 10 in its horizontal position, the movement of the back frame 12 is easier and also prevents a precipitous drop of the back frame 12. The present invention is preferably made of wood. It is desirable to maintain the parts against wear, shock or stress. When moving the sofa bed recliner 10 to its horizontal position, the tension spring 26 avoids the stress of precipitous movement of the parts and also provides a more comfortable conversion for the user of the sofa bed recliner 10, avoiding stress, shock and the noise of the clashing parts.

When moving the sofa bed recliner 10 to a horizontal position, a pulling forward of the seat frame 11, which is resting upon the front cross piece 30 of the base 13, allows the legs 21 to drop, pivoting on the pivot 23. The gravity pivoting of the legs 21 simply automates the steps employed in the use of the sofa bed recliner 10 and make it easier to use.

When reverting the sofa bed recliner 10 to sitting position, a backward movement of the seat frame 11 slides the legs 21 over the front cross piece 30, withdrawing them within the inside portion of the seat frame 11.

In a preferred embodiment of the sofa bed recliner 10, an interlock (not shown), is provided between the seat frame 11 and back frame 12. The interlock assists in the reversion of the sofa bed recliner 10 to a sitting position. The lifting of the seat frame 11, drops the legs 21, which are then stopped by the stop pin 25, at a right angle to the seat frame 11. As the reversion is completed, the legs 21 ride over the front cross piece 30 to be withdrawn within the lower portion of the seat frame 11. The stop pin 25, maintains the legs 21 at a right angle to the seat frame 11, prevents the swinging of the legs 21 and their possible engagement behind the front cross piece 30, which would defeat the use of the legs 21, or at a minimum, complicate the movements of the sofa bed recliner 10 in effecting the conversion from the sitting position to the horizontal position.

While two support arms 16 are are contemplated, as shown in the figures, a single support arm 16 in the center of the back frame 12 might functionally serve the same purpose. The support arms 16 are shown, attached to the base 13 by use of a bracket 17. The mode of such attachment is not critical to the invention, as long as support arms 16 are pivotally connected to the base 13, so that forward movement of the back frame 12, as it slides in the groove 19, prevents the top portion of the back frame 12 from any backward movement beyond the edge of the base 13. Thus, the sofa bed recliner 10 need not be moved from the position against the wall in order to effect its conversion to a horizontal position.

Two legs 21 are contemplated, as shown in the figures, one each attached at both ends of the seat frame 11. The legs 21 may also be joined by a cross bar (not shown). A single leg, preferably centered, may provide balance for the seat frame.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A sofa bed recliner having a back frame which when moving forward has substantially no rearward movement comprising, a seat frame, a back frame, and a base, said seat frame including a front portion and a rear portion, said back frame including a front portion and a rear portion, rotatable means joining said rear portion of said seat frame and front portion of said back frame, said base including end portions; a rear cross piece; and a front cross piece, said back frame and said seat frame mounted on said base, at least one support arm between said back frame and said base, said at least one support arm rotatably engaged to said base at one end and rotatably engaged to said back frame at its other end, guide means between said back frame and said base, said seat frame slideably resting on said front cross piece of said base, said guide means adapted to slideably support said back frame, said seat frame and said back frame adapted to move forward to a horizontal position and back to a sitting position, said back frame resting on said rear cross piece when said seat frame and said back frame are in horizontal position, and said seat frame including at least one leg, said at least one leg including a top portion and a bottom portion, said top portion located beneath and inward of said front portion of said seat frame, said bottom portion adapted to fit adjacent said front portion of said seat frame, said at least one leg adapted to gravitationally rotate to extend, said at least one leg adapted to freely rotate to return beneath said seat frame guided by said front cross piece of said base, said at least one leg adapted to support said seat frame when said seat frame and said back frame are in a horizontal position.

2. The invention of claim 1 including biasing means, said biasing means adapted to bias said back frame against rapid movement.

3. The invention of claim 2 including biasing means, said biasing means adapted to bias said back frame against rapid movement toward said rear cross piece of said base.

4. The invention of claim 2 wherein said biasing means is a tension spring.

5. The invention of claim 2 including said biasing means mounted at said at least one support arm.

6. The invention of claim 1 including means adapted to stop free rotation of said at least one leg substantially at a right angle to said seat frame.

7. The invention of claim 6 wherein means to stop rotation of said leg is a stop pin.

8. The invention of claim 7 wherein said stop pin is in an end rail of said seat frame.

9. The invention of claim 7 wherein the top of said at least one leg adjacent said stop pin is rounded.

10. The invention of claim 1 wherein said at least one leg is guided to return beneath said seat frame guided by said front cross piece when said sofa bed recliner is reverted to sitting position.

11. The invention of claim 10 wherein said said at least one leg is retained between said seat frame and said front cross piece when said sofa bed recliner is in said sitting position.

12. The invention of claim 1 including a plurality of support arms.

13. The invention of claim 1 including a single support arm.

14. The invention of claim 13 wherein said support arm is located substantially central of said back frame.

15. The invention of claim 1 including a plurality of legs.

16. The invention of claim 1 including a single leg.

17. The invention of claim 16 wherein said leg is located substantially central of said seat frame.

18. A sofa bed recliner having a back frame which when moving forward has substantially no rearward movement comprising, a seat frame, a back frame, and a base, said seat frame including a front portion and a rear portion, said back frame including a front portion and a rear portion, rotatable means joining said rear portion of said seat frame and front portion of said back frame, said base including end portions; a rear cross piece; and a front cross piece, said back frame and said seat frame mounted on said base, at least one support arm between said back frame and said base, said at least one support arm rotatably engaged to said base at one end and rotatably engaged to said back frame at its other end, guide means between said back frame and said base, said seat frame slideably resting on said front cross piece of said base, said guide means adapted to slideably support said back frame, said seat frame and said back frame adapted to move forward to a horizontal position and back to a sitting position, said back frame resting on said rear cross piece when said seat frame and said back frame are in horizontal position, and said sofa bed recliner including biasing means, said biasing means adapted to bias said back frame against rapid movement, said biasing means mounted at where said at least one support arm is engaged to said back frame, said seat frame including at least one leg, said at least one leg adapted to freely rotate to extend and return to said seat frame, said at least one leg adapted to support said seat frame when said seat frame and said back frame are in a horizontal position.

* * * * *